United States Patent [19]

Mitchell

[11] 4,285,278

[45] Aug. 25, 1981

[54] RAPID TRANSIT SYSTEM

[76] Inventor: Bruce Mitchell, Terreton, Id. 83450

[21] Appl. No.: 170,595

[22] Filed: Jul. 21, 1980

[51] Int. Cl.[3] ..... B61B 3/00

[52] U.S. Cl. ..... 104/96; 104/121; 104/130; 104/168

[58] Field of Search ..... 191/38; 104/96, 130, 104/121, 168

[56] References Cited

U.S. PATENT DOCUMENTS

| | | | |
|---|---|---|---|
| 3,593,665 | 7/1971 | Marty | 104/130 X |
| 3,628,462 | 12/1971 | Holt | 104/130 X |
| 3,848,535 | 11/1974 | Mitchell | 104/168 X |

*Primary Examiner*—Richard A. Schacher
*Attorney, Agent, or Firm*—John J. Posta, Jr.

[57] ABSTRACT

Improvements are provided in a rapid transit system which employs a guide line network including a main line and an interconnected side line, a car moveable throughout the network and interconnected thereto by an overhead tow bar, car drive means, and switch means for diverting the car to and from the main line and side line. The improvements include an overhead main line guide bar at and around intersections of the main and side lines, a main line guide finger vertically moveable from within the car into and out of sliding engagement with the main line guide bar, an overhead side line guide bar at and around said intersection, and a pair of turn-off guide fingers vertically moveable as a unit from within the car for sliding engagement with the side line guide bar to divert the car to the side line. These fingers are spaced lateral of both sides of the main line guide finger. Lever means in the car alternately raise and lower the turn off guide fingers and main line guide finger. The leading ends of the guide bars can be rotated or otherwise moved by remote means to control the direction of the car in an emergency. A platform with guide openings under the car at the intersection cooperates with wedge shaped guides on the car bottom to aid the car in turning into the side line. Slides on the platform aid the car bottom to slide on banded portions during turns.

8 Claims, 14 Drawing Figures

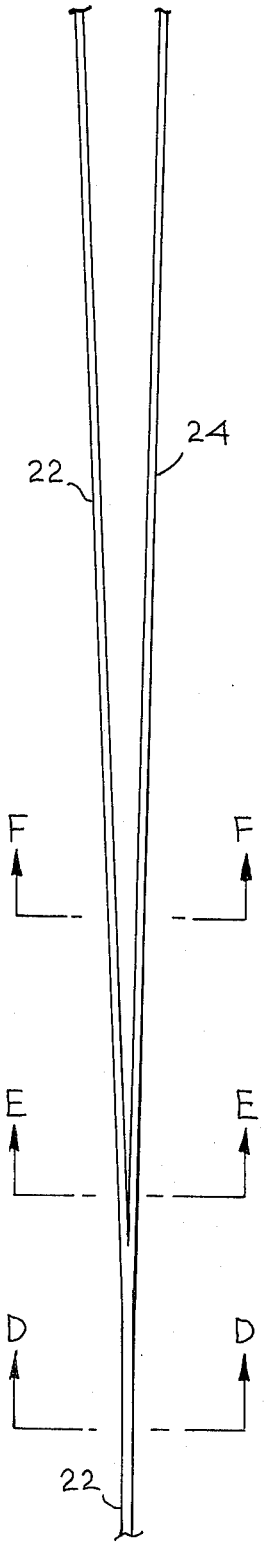
Fig. 5
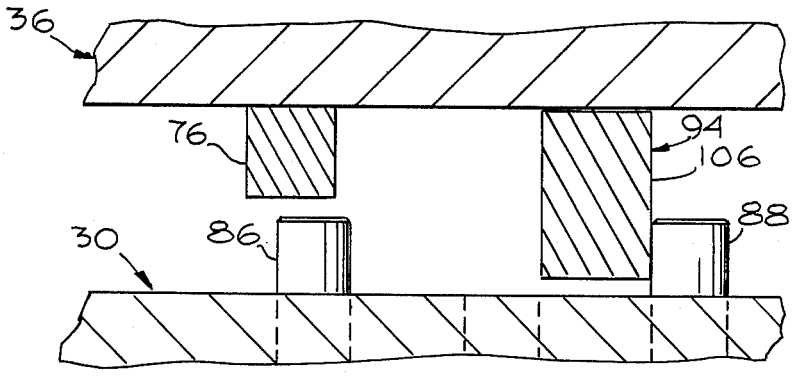
Fig. 8 (F-F)
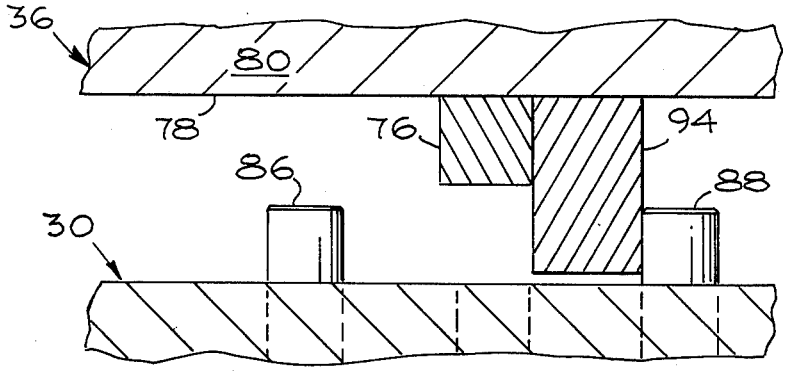
Fig. 7 (E-E)
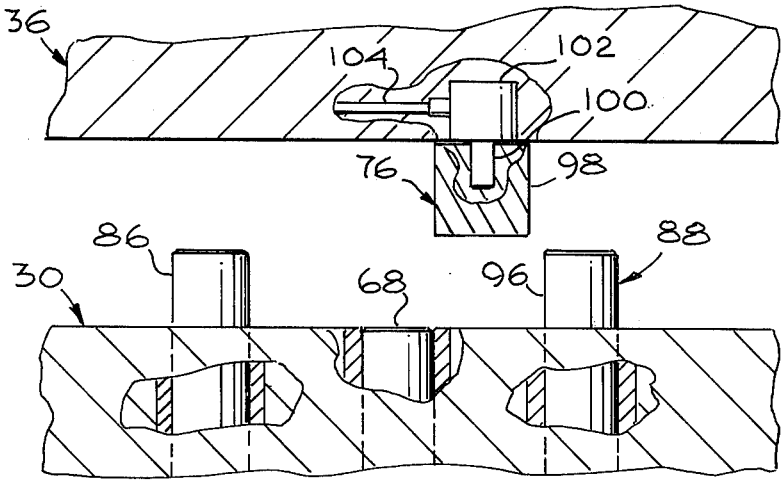
Fig. 6 (D-D)

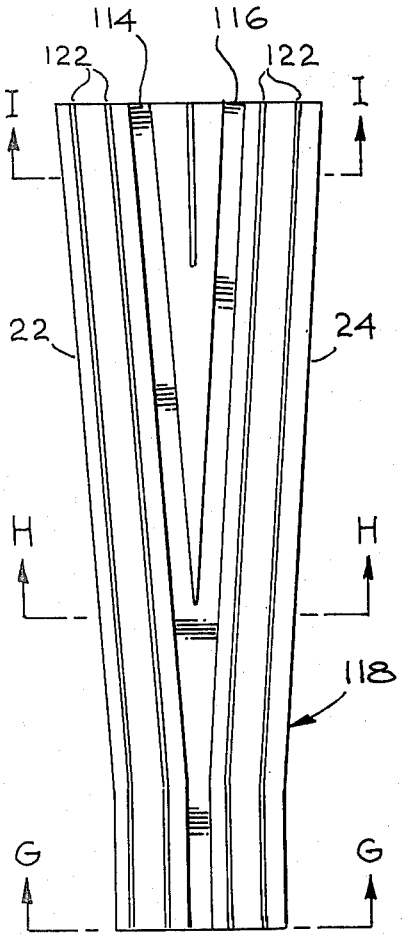
Fig. 11
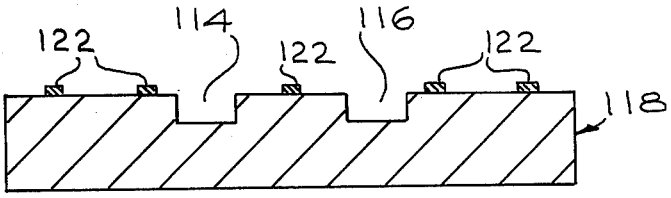
Fig. 14 (I-I)
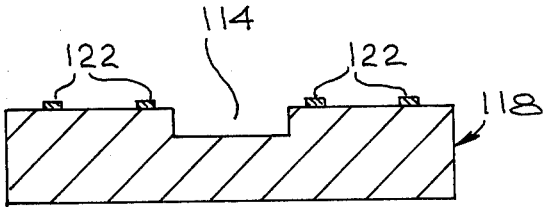
Fig. 13 (H-H)
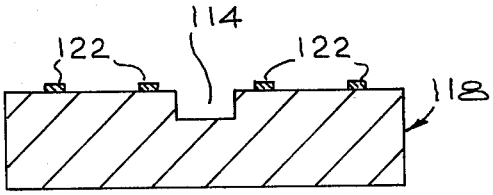
Fig. 12 (G-G)
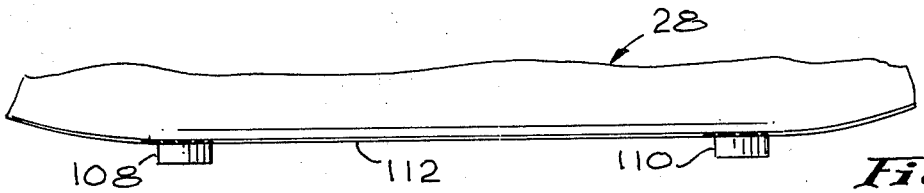
Fig. 10
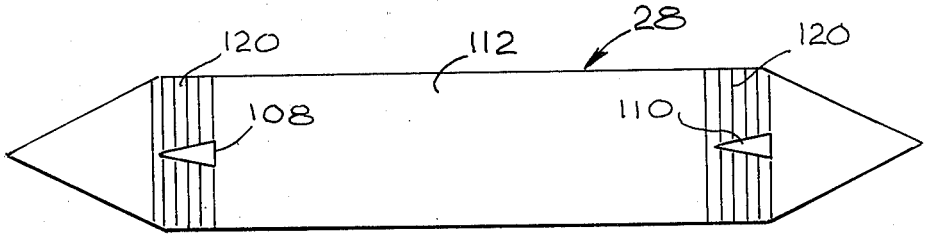
Fig. 9

RAPID TRANSIT SYSTEM

BACKGROUND OF THE INVENTION

1. Field of the Invention

The present invention generally relates to switching and turning means and more particularly to improved switching and turning means for rapid transit systems of a selected type.

2. Prior Art

U.S. Pat. No. 3,848,535 discloses and claims a unique type of rapid transit system. The system employs a series of horizontal, overhead, channeled beams slideably (or rollably) receiving the articularted, overhead tow bar of a passenger or cargo car depending therefrom.

The car is moved along the means by the power activated rotors between the ends of adjacent beams acting on the exposed edges of the tow bar as it bridges the beams. A main line of one series of beams is provided, as well as one or more side lines (of a series of beams) branching off therefrom to stations and returning to the main line.

The patent employs selected switching means to guide the car to and from the main line. Such switching means are effective but provide less passenger control of the car direction than is desired.

Accordingly, improved switching and turning means which will increase control by the car passenger of the car's direction would be very useful and desirable for the system. Such improved switching means should provide safety in emergency conditions and should render the switching and turning operation as simple, effective and smooth as possible.

SUMMARY OF THE INVENTION

The improvements of the present invention, such as are substantially set forth in the abstract above, satisfy all of the foregoing needs. These improvements in the described rapid transit system are simple, effective, result in smooth torque-free turning and are under full control of the car passengers. Yet they also provide for emergency situations such as full side stations, blocked lines and the like, where automatic control of the car's direction is needed. Lever operated fingers cooperate with main line and side line guide bars to shunt the car as the passenger desires.

The guide bars also include sections under automatic remote control to prevent or force shunting as emergency conditions dictate. Wedge-shaped guides on the undersurface of the car cooperate with a grooved platform below the car to support and guide the car during turns at line intersections. Slides on the platform facilitate the turning. Further features are set forth in the following detailed description and accompanying drawings.

DRAWINGS

FIG. 5 is a schematic diagram showing an intersection between the main line and side line of the transit system of FIG. 1;

FIG. 6 is a schematic cross section taken along the section line D—D of FIG. 5 and being partly broken away, showing the fingers of FIG. 4 in a mode to switch the attached car to the side line and showing the horizontally rotatable end of the main line guide bar;

FIG. 7 is a schematic cross section, taken along the section line E—E of FIG. 5, showing the fingers of FIG. 6 in the mode of FIG. 6;

FIG. 8 is a schematic cross-section, taken along the section line F—F of FIG. 5, showing the fingers of FIG. 6 in the mode of FIG. 6;

FIG. 9 is a schematic bottom plan view of wedge-shaped guides attached to the transit car of FIG. 1;

FIG. 10 is a schematic side elevation of the guides and car of FIG. 9;

FIG.11 is a schematic plan view and turn guide of platform adjacent the intersection of main line and side line;

FIG. 12 is a schematic cross-section, taken along the section line G—G of FIG. 11, of a preferred embodiment of the platform of FIG. 11, which platform is used to support the transit car during a turn into a side line from the main line or vice versa;

FIG. 13 is a schematic cross-section, taken along the section line H—H of FIG. 11; and, FIG. 14 is a schematic cross-section, taken along the section line I—I of FIG. 11.

DETAILED DESCRIPTION

FIGS. 1–3

Figure 1:
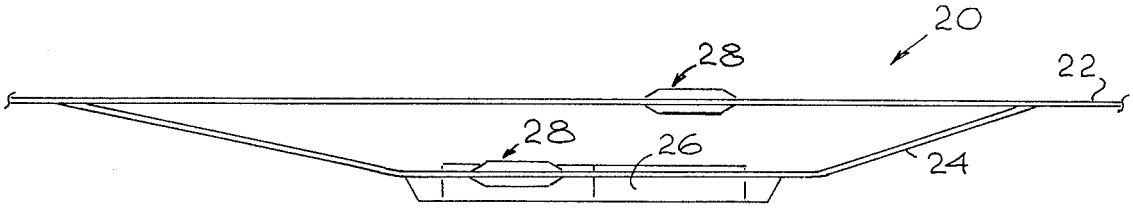
FIG. 1 is a schematic diagram depicting a preferred embodiment of a portion of the rapid transit system employing the improvements of the present invention.
Figure 2:
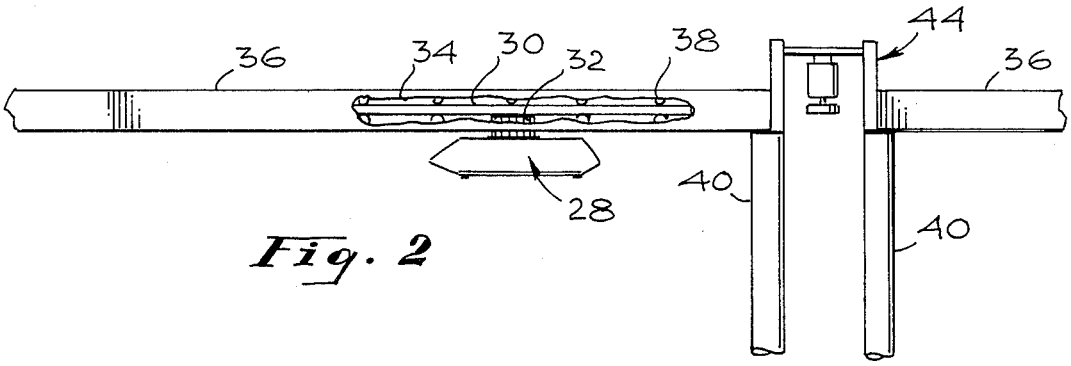
FIG. 2 is a fragmentary schematic side elevation of a portion of the transit system of FIG. 1.
Figure 3:
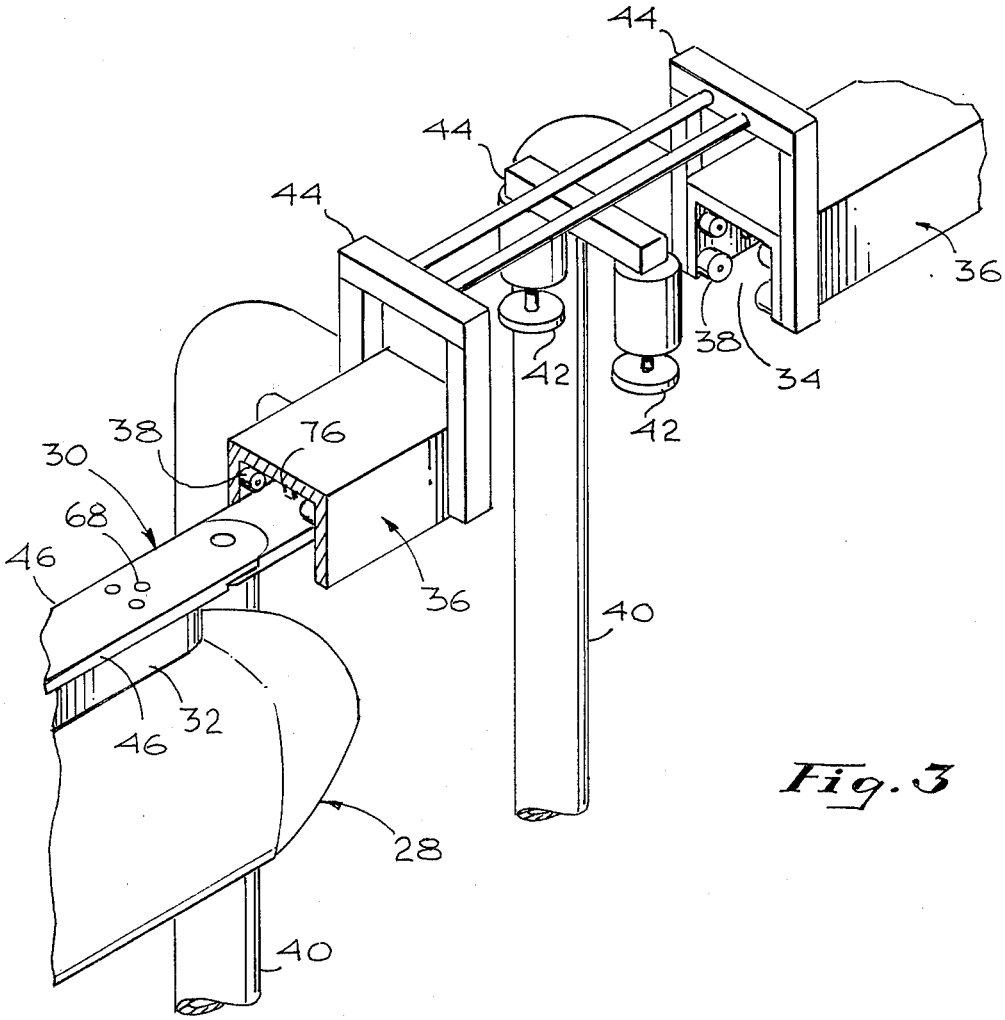
FIG. 3 is a schematic perspective view of the drive means for the transit system portion in FIG. 2.

Now referring more particularly to FIGS. 1–3, a rapid transit system is depicted in which the switching improvements of the present invention are utilized. Thus, a rapid transit system 20 is shown in FIG. 1 to include a main line 22 an interconnected side line 24, the latter running to a station or terminal 26 and one or more passenger and/or cargo cars 28 moveable throughout lines 22 and 24.

As more particularly illustrated in FIGS. 2 and 3, each car 28 is connected to and depends from an elongated flat, horizontal articulated tow bar 30 by a vertical support 32. Tow bar is slideably or rollably received within the channels 34 of horizontal beams 36 as by spaced rollers 38. Beams 36 are longitudinally spaced apart and supported on vertical stanchions 40. Tow bar 30 is longer than the distance between adjacent beams 36.

Drive means in the form of a pair of spaced remotely power driven rollers 42 are disposed on support brackets generally designated 44 in the gap between the ends of each set of adjacent beams 36, and impart longitudinal movement to tow bar 30 by frictional rotation against the side edges 46 of bar 30. Further details of construction of system 20 are set forth in U.S. Pat. No. 3,848,535. Such system employs means for switching cars 28 between main line 22 and side line 24.

FIGS. 4–8

Figure 4:
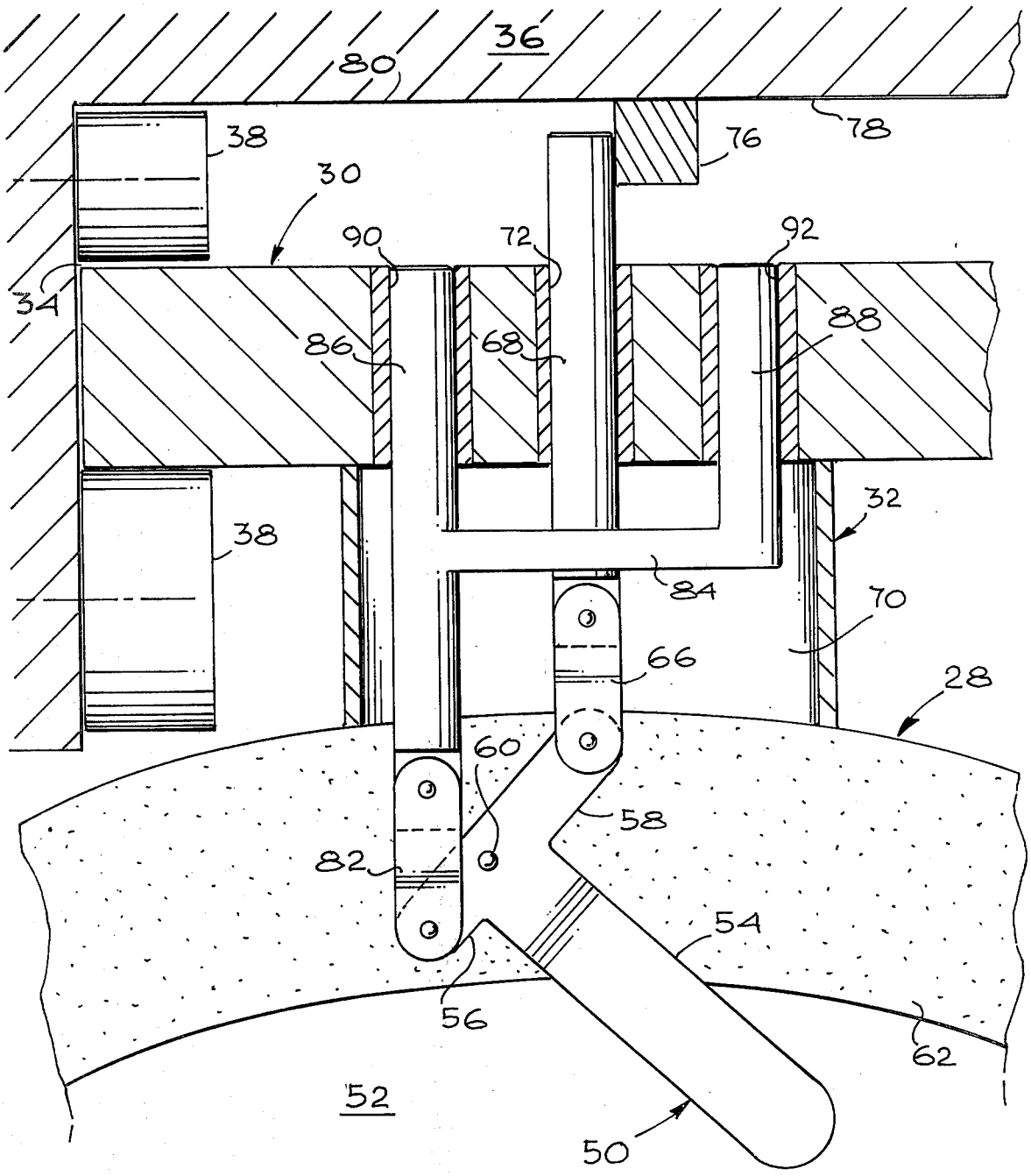
FIG. 4 is a schematic front elevation, partly broken away and partly in section, showing a preferred embodiment of a portion of the improved switching means of the present invention.

The improvements forming the present invention comprise improvements in switching and turning means utilizable in system 30. Certain of such improvements are schematically illustrated in FIGS. 4–8. Thus, in FIG. 4 is shown, partly in cross-section and partly broken away, a hand lever 50 which is disposed in the cabin 52 of car 28. Lever 50 is generally T-shaped, with an elongated handle 54 and at one end thereof a pair of arms 56 and 58 forming the T with the handle.

Lever 50 may have one or more biasing springs (not shown) or the like to hold it in a desired position. For example, a biasing spring (not shown) could have one end secured to frame 62 directly above pivot 60 and to lever 50 midway thereacross below pivot 60, which would cause the handle 54 to come to rest to the right or left side of pivot 60, in a toggle action manner. Lever 50 is pivotally secured, as at point 60 to, for example, the face of the front frame 62 of car 28, which is also connected to frame 62. A link 66 pivotally connects arm 58 with a cylindrical vertically aligned main line guide finger 68 which extends up through space 70 within support 32 and into an opening 72 in tow bar 30.

Bar 30 is shown in FIG. 4 disposed in channel 34 of beam 36. Finger 68 is dimensioned so that when handle 54 is in the position shown in FIG. 4, the upper end of Finger 68 rises above tow bar 40 a sufficient height so as to slideably engage one side of a main line guide bar 76.

Guide bar 76 may be, for example, square in cross-section and elongated, and is secured to the underside 78 of the portion 80 of beam 36 which overlies channel 34. Beam 36 is one of the main line 22 and guide bar 76 is disposed therein somewhat upstream, at and somewhat downstream of the intersection of lines 22 and 24. With finger 68 raised, bar 76 prevents car 28 from turning right and going into line 24 from line 22. It will be understood that if side line 24 were on the left of line 22, bar 76 would be positioned relative to finger 68 to prevent car 28 from turning left into line 24.

Arm 56 of lever 50 is pivotally connected by a link 82 to a frame 84 holding a vertical spaced pair of cylindrical side line guide fingers 86 and 88 which fingers 86 and 88 extend up through support 32 and through cylindrical openings 90 and 92 in tow bar 30. Fingers 86 and 88 are on opposite sides of and spaced from finger 68.

FIGS. 5–8

The linkage of lever 50 is such that when finger 68 is extended up into the operative condition shown in FIG. 4, (as by moving handles clockwise as far as possible) fingers 86 and 88 are withdrawn into tow bar 30. Conversely, if handle 54 is fully rotated counterclockwise, fingers 86 and 88 are moved into the operative position above tow bar while finger 68 is simultaneously withdrawn into tow bar 30. This latter condition is shown in FIGS. 6–8.

FIG. 5 depicts a part of system 10 wherein side line 24 diverges from main line 22. In order to cause car 28 to turn off onto line 24 instead of proceeding on line 22, handle 54 is rotated counterclockwise to raise fingers 86 and 88 and simultaneously lower finger 68. A longitudinally extending side line guide bar 94, which extends down closer to tow bar 30 than does bar 76, is secured to the underside 78 of portion 80 of a beam 36 which is part of line 24.

Finger 86 is initially on one side of bar 76 and finger 88 is on the opposite side of bar 76; fingers 86 and 88 are short enough to pass under bar 76 but not under bar 94. Fingers 86 and 88 are spaced such that the surface 96 of finger 88 slideably engages the adjoining surface of bar 94 as it appears at the intersection causing car 28 to turn off onto line 24.

FIG. 6 shows fingers 86 and 88 on main line 22. FIG. 7 shows fingers 86 and 88 straddling both line 22 and line 24, while FIG. 8 shows the same situation farther down line 24. Accordingly, fingers 86 and 88 when in the operative position act to divert car 28 to side line 24 while finger 68 (when in the operative position) acts to hold car on main line 22.

Means are also provided to automatically control the direction of car 28 and override normal control of fingers 68, 86 and 88, in the event of an emergency. Thus, the near end 98 is segmented and can rotate horizontally, laterally, as on a pin 100 driven by an electric jack or motor 102 disposed in beam 36 and powered remotely as through line 104.

Thus, for example, a central terminal or the like can automatically send a signal to actuate motor 102 through current in line 104 as car 28 approaches end 98. Such rotation is arranged to deflect finger 68, to the side of bar 76 facing side line 24, causing car 30 to turn onto line 24 instead of proceeding along line 22.

Similarly, near end 106 of bar 94 can be segmented (not shown) to rotate (or otherwise) move, under remote control such as that shown for bar 76. Such movement is arranged to divert car 28 back to line 22 (as when a station destination is already filled with car 28) when fingers 86 and 88 are up for a turn to line 24. Thus end 106 can be pivoted to cause finger 88 to move into the space between bar 76 and bar 94 and thus cause car 28 to continue down line 22.

It will be understood that fingers 68, 86 and 88 offer the passenger in car 28 the opportunity except in an emergency, to turn off onto any desired side line 24 and thus arrive at any desired station 26 destination. When the passenger enters car 28, he pushes lever 50 clockwise to start car 28. Lever 50 is locked in place by a spring-loaded catch or the like (not shown).

Lever 50 is keyed to start drive means such as adjacent rollers 42 so that car 28 will go out onto the main line 22 past all stations 26 until the passenger moves lever 50 all the way counterclockwise where it is locked in place by a spring latch (not shown). Car 28 will automatically turn off at the next line 22 and go into station 26 and stop by suitable power cut-off means (not shown). The passenger leaves car 28 with lever 50 in the same turn off position. Car 28 can then automatically be sent ahead to the next station 26 if desired.

FIGS. 9–14

Turning means are also provided to assist car 28 in making the turn into line 24 from line 22 and back again. Such means include two spaced arrow-shaped or wedge-shaped longitudinally aligned guides 108 and 110 (FIG. 9) secured to the bottom 112 of car 28.

Guides 108 and 110 fit into grooves 114 and 116 of a flat platform 118 held horizontally above ground immediately below car 28, as by stanchions (not shown) at a height to accept guides 108 and 110.

Platform 118 is present in the area immediately before, at and immediately after each intersection of lines 22 and 24 to stabilize car 28 during a turn.

As can be seen from FIG. 11 and FIG. 12, groove 114 is initially narrow before the intersection but wide enough to accept guides 108 and 110, but broadens at or about the intersection (FIG. 13) and then diverges after the intersection into grooves 114 and 116, each adapted to accept guides 108 and 110.

Thus, platform 118 in FIG. 14 in effect spans the width of lines 22 and 24 (not shown) immediately downstream of the intersection.

The bottom 112 of car 28 can be stiffened with a plurality of parallel metal bands 120 in the area of guides 108 and 110 (FIG. 9) so that car 28 will easily slide on elongated low profile metal slides 122 (FIGS. 12, 13, 14) spaced along the upper surface of platform 118 without damage. A part of tow bar 30 is supported on only one side during a part of each turn. However, sliding of bottom 112 on slides 122 during a turn will relieve torsion otherwise present on tow bar 30. Thus, each turn can be made smoothly and without straining components of car 28.

The improvements specified herein relating to switching and turning of car 28 to and from lines 22 and 24 are all simple, inexpensive, durable, lightweight and efficient. They all can be constructed of suitable readily available materials, preferably steel or other metals, etc. They assure maximum passenger comfort and individual car control in system 10 with proper safety. Other advantages are as set forth in the foregoing.

Various modifications, changes, alterations and additions can be made in the improvements of the present invention and in the components and parameters thereof. All such modifications, changes, alterations, and additions as are within the scope of the appended claims form part of the present invention.

What is claimed is:

1. In a rapid transit system having a guide line network including a main line and one or more interconnected side guide lines, a car moveable throughout said network, an overhead tow bar interconnecting said car with said guide line network, car drive means, and switch means for diverting said car to and from said main line and said side lines, the improvement comprising improved switch means comprising, in combination:

a. an overhead main line guide bar extending along said main line immediately before, at and immediately after the intersection of said main line and said side guide line;

b. a main line guide finger manually moveable vertically from within said car into and out of sliding contact with the side of said main line overhead guide bar away from said side guide line;

c. an overhead side line guide bar extending along said side line immediately before, at and immediately after said intersection;

d. a pair of turn off guide fingers spaced laterally on each side of main line guide finger and manually movable vertically as a unit from between said car for sliding engagement with said side line guide bar to divert said car to said side line; and e. lever means connected to said three fingers to simultaneously raise said side line guide fingers while lowering said main line guide finger and vice versa.

2. The improvement of claim 1 wherein said main line guide finger is extendable farther above said car than said side line guide fingers are extendable and wherein said side line guide bar is closer to said car than said main line guide bar, said side line guide fingers, when raised, being below said main line guide bar.

3. The improvement of claim 2 wherein said fingers extend through vertical passageways in said tow bar.

4. The improvement of claim 3 wherein said lines each comprise a plurality of longitudinally spaced beams, each containing a channel within which said tow bar is slideably received and wherein said guide bars are fixed to the underside of that portion of said beams which face said channel.

5. The improvement of claim 1 wherein the leading end of said main line guide bar is rotatable horizontally to divert said car to said side line and wherein remote control means are connected thereto to effect said horizontal rotation for emergency purposes.

6. The improvement of claim 1 wherein a leading portion of said side line guide bar adjacent said intersection is removable or rotatable to cause said car to continue along said main line even when said side line guide fingers are up and said main line guide finger is down.

7. The improvement of claim 1 wherein said car includes on the bottom thereof a longitudinally spaced aligned pair of wedge shaped guides and wherein a platform 10 is disposed upstream of and along said intersection and for a distance downstream thereof spanning said mainline and said side line below said car, said platform defining in the upper surface thereof grooves to receive said wedge shaped guides to facilitate stabilization of said car during a turn into said side line.

8. The improvement of claim 7 wherein said platform includes spaced slides on the upper surface thereof and wherein the bottom of said car includes stiffeners to facilitate sliding engagement of said car bottom with said slides during turning of said car.

* * * * *